United States Patent [19]

Harding et al.

[11] 4,105,908

[45] Aug. 8, 1978

[54] METAL HALIDE LAMP HAVING OPEN TUNGSTEN COIL ELECTRODES

[75] Inventors: Thomas J. Harding, Aurora; Wayne R. Hellman, Twinsburg, both of Ohio

[73] Assignee: General Electric Company, Schenectady, N.Y.

[21] Appl. No.: 681,790

[22] Filed: Apr. 30, 1976

[51] Int. Cl.[2] ..... H01J 61/068; H01J 61/18

[52] U.S. Cl. ..... 313/217; 313/218; 313/229

[58] Field of Search ..... 313/184, 217, 211, 213, 313/229, 218

[56] References Cited

U.S. PATENT DOCUMENTS

| | | | |
|---|---|---|---|
| 2,171,234 | 8/1939 | Freeman | 313/211 X |
| 2,441,863 | 5/1948 | Zabel | 313/211 X |
| 2,765,420 | 10/1956 | Martt | 313/344 |
| 3,313,974 | 4/1967 | Koury et al. | 313/218 |
| 3,937,996 | 2/1976 | Cap | 313/217 |
| 3,979,624 | 9/1976 | Liu et al. | 313/229 |

FOREIGN PATENT DOCUMENTS

| | | | |
|---|---|---|---|
| 1,014,340 | 12/1965 | United Kingdom | 313/213 |

*Primary Examiner*—Palmer C. Demeo

*Attorney, Agent, or Firm*—Ernest W. Legree; Lawrence R. Kempton; Frank L. Neuhauser

[57] ABSTRACT

In a metal halide lamp of the sodium-scandium-thorium iodide type utilizing tungsten electrodes without emission mix, lumen depreciation during life results primarily from blackening of the arc tube wall by electrode sputtering during the glow-to-arc transition phase of lamp start-up. The glow-to-arc transition is speeded up by a lower glow-to-arc transition voltage which is achieved by using electrodes comprising an open tungsten wire coil on a tungsten shank, the coil comprising two layers of a composite wire may be open-winding a 2 mil overwind on a 4 mil core and then close-winding two layers of the composite wire on the shank. This decreases sputtering at starting and improves lamp maintenance.

10 Claims, 6 Drawing Figures

Fig. 3 Fig. 4 Fig. 5
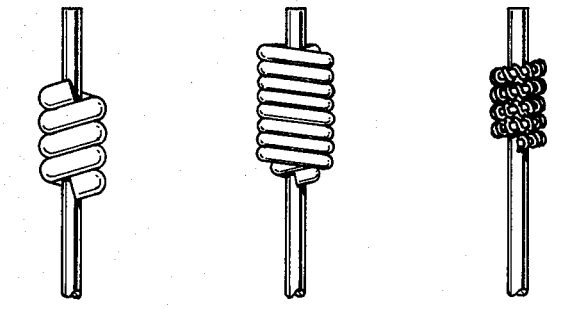
A B C
PRIOR ART
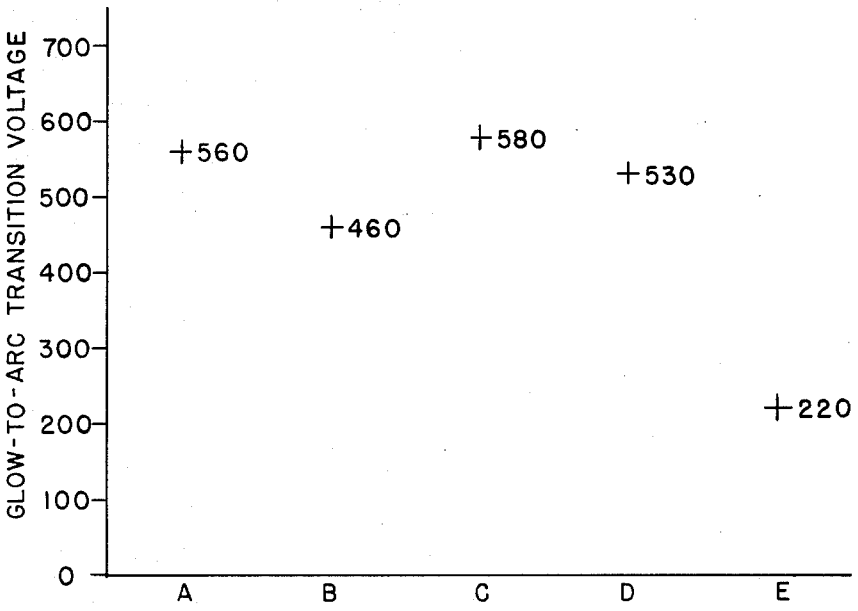
Fig. 6

METAL HALIDE LAMP HAVING OPEN TUNGSTEN COIL ELECTRODES

The invention relates to high pressure metal vapor discharge lamps, and more particularly to metal halide discharge lamps such as those containing scandium wherein the electrodes cannot be activated by a coating of thorium oxide.

BACKGROUND OF THE INVENTION

High pressure metal vapor discharge lamps commonly utilize compact self-heating electrodes. A common design is a two-layer coil on a tungsten shank wherein the inner layer has spaced turns and the outer layer is close-wound over the first, the interstices between turns being filled with emissive materials. Materials commonly used are metal oxides, for instance mixtures of alkaline earth oxides including barium oxide for mercury vapor lamps, and thorium oxide for metal halide lamps. The shank projects through the coil and forms a tip to which the arc attaches with formation of a hot spot.

In metal halide lamps containing scandium iodide, metal oxides are not generally used as electrode activators because a reaction takes place wherein the scandium iodide is converted into scandium oxide having a much lower vapor pressure. The result is that scandium is effectively removed from the discharge and no longer generates its spectral lines. One solution to this problem has been to use bare, that is unactivated, tungsten electrodes and to add thorium iodide to the fill. During the discharge, pyrolytic decomposition of the thorium iodide takes place and is followed by condensation of thorium metal on the electrode surface particularly on the tip of the shank, yielding a surface which emits electrons efficiently. An iodine transport cycle continually replenishes the quantity of thorium on the electrode tip and the thorium layer also shields the tungsten from erosion. Thus a reasonably efficient electrode activation system is provided but blackening of the arc tube walls and lumen depreciation with this type of electrode is rather high, for instance maintenance down to 72% at 2000 hours on a 175 watt lamp.

The object of the invention is to provide an improved electrode for such lamps achieving better maintenance and improved starting characteristics.

SUMMARY OF THE INVENTION

In the operation of metal vapor arc lamps, a potential exceeding the initial breakdown voltage and adequate to start a glow discharge between a main electrode and a starting electrode close to it is applied, whereupon ionization spreads throughout the arc tube and the glow covers the electrodes. As the current continues to increase, the discharge proceeds into the abnormal glow phase wherein both current density and voltage drop at the electrodes increase. During this phase the electrode is subjected to severe bombardment by positive ions. This causes disintegration of the electrode surface or sputtering, wherein tungsten particles lost from the electrodes are deposited on the nearby surfaces and progressively darken the vitreous walls.

The abnormal glow phase culminates in an arc, and the more quickly the lamp goes through the glow-to-arc transition, the less the degree of disintegration and sputtering. The power supply or ballast for the lamp must supply a voltage at the prevailing volt-ampere loading which is adequate to force the glow-to-arc transition to take place. We have observed that for a given ballast, the time interval required for the glow-to-arc transition and the degree of cathode sputtering is a function of the glow-to-arc transition voltage, sometimes known as the second breakdown voltage of the lamp. The lower the second breakdown voltage, the more rapidly the transition takes place and the less the degree of electrode damage and envelope darkening.

In accordance with our invention, we have found that the glow-to-arc transition voltage in scandium containing metal halide lamps may be drastically lowered by providing electrodes comprising an open fine wire multilayer tungsten coil on a tungsten shank. This coil is open, that is, it is an open structure and it is not filled with activation material. Its design affects the heat balance of the electrode in such a way as to permit the passage of the electrode through the abnormal glow phase with a minimum expenditure of energy.

Desirably the electrode coil is made of a composite tungsten wire comprising a mandrel of not more than 5 mils and an overwind of not more than 4 mils wrapped snugly around the mandrel at a winding pitch leaving gaps between turns of at least about the same width as the overwind wire. The composite wire is then substantially close-wound on a tungsten shank, that is, it is wound with gaps between turns not exceeding about half the composite wire width. It is convenient to reverse the winding pitch between successive layers in order to insure that the layers remain spaced out one on top of the other without intermeshing. A preferred construction utilizes a 4 mil mandrel wire around which is wound a 2 mil overwind wire at a winding pitch leaving gaps between wires of about 2 mils. The composite wire is then wound in two layers on a tungsten shank adequate in current carrying capacity for the intended lamp.

DESCRIPTION OF DRAWING

FIGS. 3, 4 and 5 are views of prior art electrodes for purposes of comparison.

FIG. 6 is a graph comparing the glow-to-arc transition voltages of electrodes embodying the invention with those of the prior art.

DETAILED DESCRIPTION

Figure 1:
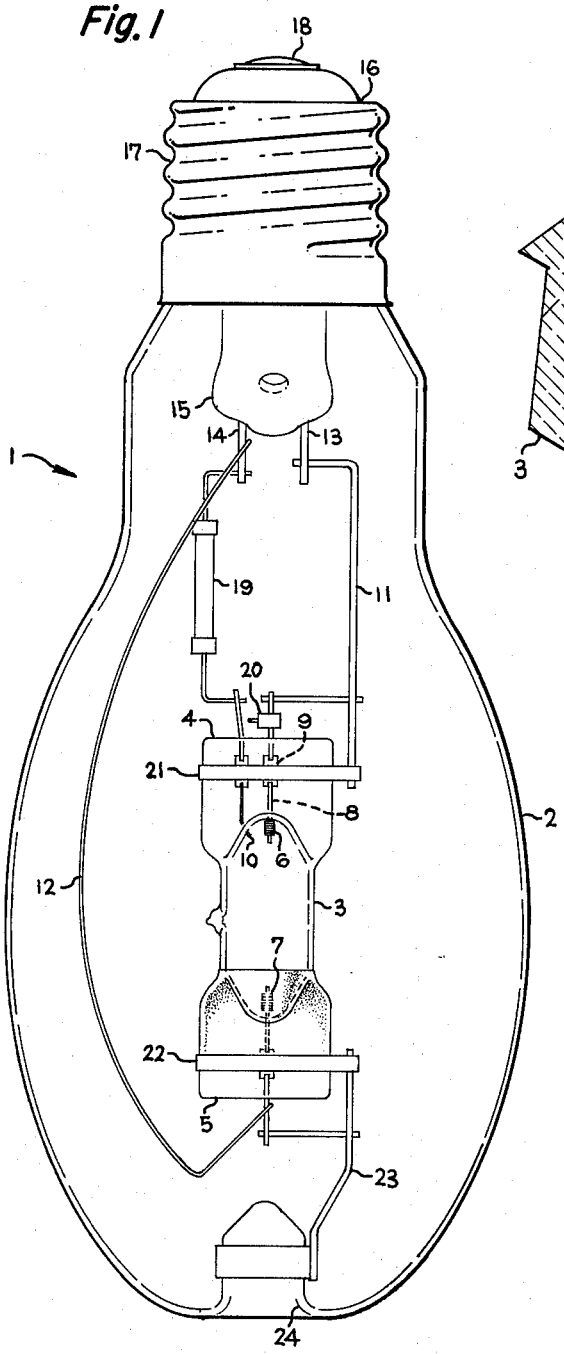
FIG. 1 is a side view of a scandium iodide lamp in which the arc tube has open wound coil electrodes embodying the invention.

FIG. 1 shows a metal halide lamp 1 of 175-watt size utilizing our improved open-wound coil electrodes. It comprises an outer glass envelope 2 containing a quartz or fused silica arc tube 3 having flat-pressed or pinched ends 4, 5. Main electrodes 6, 7 embodying the invention are mounted in opposite ends of the arc tube. Each main electrode includes a shank portion 8 which extends to a molybdenum foil 9 to which an outer current conductor is connected. The hermetic seal is made at the molybdenum foil upon which the fused silica of the pinch is pressed during the pinch sealing operation. An auxiliary starting electrode 10 is provided at the upper end of the arc tube close to main electrode 6 and consists merely of the inwardly projecting end of a fine tungsten wire. Main electrodes 6, 7 are connected by conductors 11, 12 to outer envelope inleads 13, 14 sealed through stem 15 of the outer envelope or jacket 2. The outer envelope inleads are connected to the contact surfaces of screw base 16 attached to the neck end of the envelope, that is to the threaded shell 17 and to the insulated center contact 18. Auxiliary electrode 10 is connected by current limiting resistor 19 to outer envelope inlead 14 whereby at starting it is placed at the same potential as the remote main electrode 7. A thermal switch 20 of the bimetal type short circuits the auxiliary electrode to the adjacent main electrode 6 after the lamp has warmed up. The arc tube is supported within the outer envelope primarily by the metal straps 21, 22 which wrap around the pinches 4,5 and which are attached respectively to conductor 11 and to a support member 23 which engages inverted nipple 24 at the dome end of the outer envelope.

In the illustrated embodiment, the arc tube contains a quantity of mercury which is substantially completely vaporized and exerts a partial pressure of 1 atmosphere or more during operation, in practice 4 to 8 atmospheres. In addition it contains metal iodides in excess of the quantities vaporized at the operating temperature and which include sodium iodide, scandium iodide, and thorium iodide. Alternatively, thorium iodide may be left out of the fill provided some thorium is included otherwise, for instance by using thoriated tungsten wire shanks in the electrodes, that is shanks of tungsten containing a small percentage of thorium oxide. An inert rare gas at a low pressure, for instance argon at 25 torr, is included in the arc tube to facilitate starting and warm-up. The illustrated lamp is intended for base up operation and the lower end of the arc is coated with a white heat and light reflecting material, indicated at 25 by speckling, which raises the temperature of the lower end of the arc tube.

Figure 2:
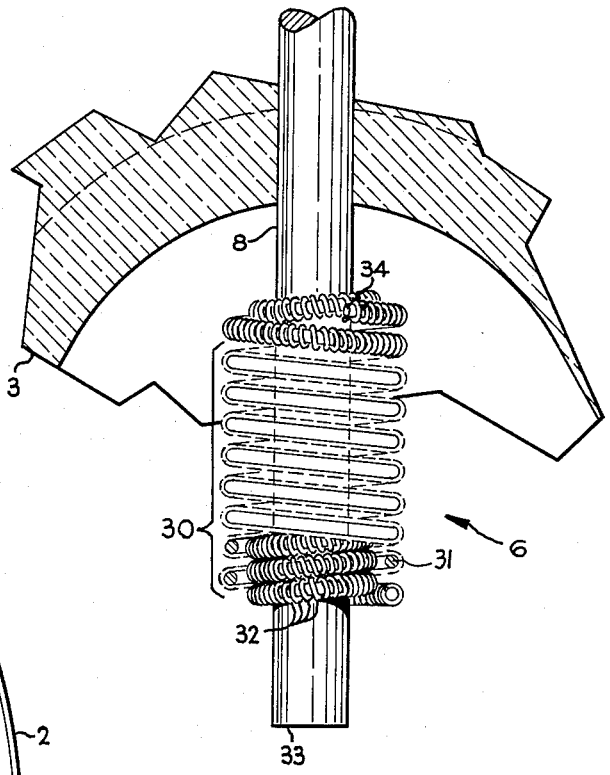
FIG. 2 is a view to a larger scale of one of the electrodes with part of the top layer peeled back to expose the lower layer.

A large scale view of one of the main electrodes is shown in FIG. 2. The following detailed description of the electrode is given as an example of a specific embodiment of the invention suitable for the arc tube of a commercial metal halide lamp of the scandium type sold under the trademark Multi-Vapor and designated in the trade as MV 175/BU and operating at about 175 watts on 1.5 amperes current. The electrode is made up of a shank 8 of 20 mil tungsten wire containing 2% thorium oxide, known as 2% thoriated tungsten, which supports the coil 30. The coil is made by first winding on a mandrel 31 of 4 mil tungsten wire an overwind of 2 mil tungsten wire at a pitch leaving a gap between successive turns 32 about equal to the thickness of the overwind wire. The open winding of the primary or overwind turns in this fashion exposes practically the entire surface of the small radius overwind wire. Thereafter the composite wire is close wound into secondary turns on shank 8, in this instance at 120 turns per inch, in two layers with one layer overlying the other and with pitch reversed as shown. By winding forward in one direction and then back-winding over what has already been laid down, a desirable open structure is achieved. The electrode may consist of 2 layers with approximately 10 turns in each layer, the coil length being approximately 2 millimeters and the shank tip 33 projecting approximately 1 millimeter beyond the distal end of the coil. The secondary coiling is springy when first wound and would unravel at least in part when released. Unraveling is prevented by welding the composite wire to the shank. This may be done by discharging a capacitor through an electrode which is pressed against the coil close to the cut end 34 but before the wire is cut, the shank serving as the return conductor for the welding current.

Our improved open-wound coil electrodes have the advantage of an appreciably lower glow-to-arc transition voltage than prior art electrodes. The result is less sputtering during starting and better maintenance which lengthens the useful life of the lamp. Also less voltage rise occurs as the lamp ages which eases the ballast requirement. They have lower glow-to-arc transition voltage than conventional cathodes which have been used in scandium iodide lamps up to now.

While electrode structures using a coiled coil or a triple coiled wire configuration have been used in the past, they have included a filling or coating of electron-emitting material and the function of the wire mesh was to hold a large quantity of emission material. Examples of such electrodes are those used in rapid start and in instant start fluorescent lamps as described for instance in Pat. Nos. 2,306,925 — Aicher and 2,774,918 Lemmers. Our electrodes are different from those in that they are an open mesh structure without filling or coating, and they also differ in winding details.

FIGS. 3, 4 and 5 show three prior art electrodes which have been closely copied from electrodes used in metal halide lamps sold commercially by different lamp manufacturers. In FIG. 3 the shank is 22 mil 2% thoriated tungsten wire and the coiling consists of 4 turns of 20 mil tungsten wire closewound into a helix. In FIG. 4 the shank is again 22 mil 2% thoriated tungsten wire and the coiling consists of 2 layers of close-wound 15 mil tungsten wire. In FIG. 5 a composite wire is used comprising a 5 mil overwind on a 7 mil mandrel, the overwind being open wound on the mandrel. A single layer of the composite wire comprising five turns is then close wound on a 22 mil 2% thoriated tungsten wire shank.

In the graph of FIG. 6, the results obtained with lamps using the cathodes of FIGS. 3, 4 and 5 are represented at A, B and C respectively. At D, the results were obtained with a cathode using the overwind and mandrel combination illustrated in FIG. 2, that is, an open-wound 2 mil overwind on a 4 mil mandrel to make a composite, and the composite then close-wound on a shank. However only a single layer was wound on the shank. The shank is of 2% thoriated tungsten wire of 22 mil size: this size was used for comparison purposes in order to match that of FIGS. 3, 4 and 5. At E, the results were obtained with a lamp using cathodes embodying the invention, that is same composite wire as illustrated in FIG. 2, but with 2 layers close-wound on the shank; again a 22 mil shank of 2% thoriated tungsten wire was used for matching purposes. The cathodes were incorporated into scandium iodidecontaining arc tubes of 250 watt rating, slightly larger in size than that illustrated in FIG. 1 and previously described. Several arc tubes of each kind were made for the test in order to have statistically significant results, and the mean values have been plotted in FIG. 6.

Referring to FIG. 6, it is observed that the mean glow-to-arc transition voltage is always higher with a single layer coil than with a two layer coil of the same design. Thus it is 560 volts at A, 580 volts at C and 530 volts at D; there is little change notwithstanding the wide variation in cathode types or winding configurations represented. When the solid type wound electrode is changed into a two layer structure, there is a drop in glow-to-arc transition voltage: thus the voltage at B is down to 460 volts as against 560 volts at A. However the really surprising result occurs when the single layer winding configuration of D is made into the two layer structure of E; the glow-to-arc transition voltage now drops from 530 volts to 220 volts. The cathode embodying the invention has better than halved the glow-to-arc transition voltage. Comparing the maintenance of the lamps represented at A and B with that of the invention at E, the relative lumens were 69% and 86% respectively measured after the same number of hours of operation. Life tests run on lamps embodying the invention and made for commercial sale give a maintenance of 84% at 2000 hours.

The cathode specifically illustrated in FIG. 2 is suitable for 175 and 250 watts scandium iodide lamp. For smaller wattage lower current lamps, finer wires may be used except that tungsten wire finer than 1.5 mil is so fragile and difficult to handle as to be impractical. For higher wattage lamps drawing heavier currents we may use an overwind wire up to 4 mils on a mandrel wire up to 5 mils with which to make the composite wire. The layers of the helically wound composite wire may exceed two.

One explanation for the improved maintenance achieved with lamps embodying the invention reasons that since a glow emission is involved which is increased by the electric field strength, the sharper radii provided by the overwind increase both the emission density and the number of emission points. The relatively high emission from a lightweight structure having a low thermal conductivity permits a rapid increase in temperature and this process accelerates the transition from glow-to-arc. Irrespective of the explanation, the lower glow-to-arc transition voltage and the reduced sputtering achieved with our invention are experimentally established facts.

What we claim as new and desire to secure by Letters Patent of the United States is:

1. An arc tube for a metal halide lamp comprising a light-transmitting envelope having electrodes sealed into opposite ends and containing an ionizable fill including metal halide, thorium within said envelope, one of said electrodes comprising a tungsten shank of a size adequate in current-carrying capacity for said lamp projecting into said envelope and an open tungsten wire coil wrapped around the distal end of said shank and spaced from its tip, said coil being made of a composite tungsten wire comprising primary turns of an overwind wire of not more than 4 mils wrapped snugly around a mandrel wire of not more than 5 mils at a winding pitch leaving gaps between turns of at least about the same width as the overwind wire, the composite wire being substantially closewound on the shank into secondary turns and said coil comprising at least two layers of said secondary turns.

2. An arc tube as in claim 1 wherein the thorium within said envelope is provided as thorium iodide.

3. An arc tube as in claim 1 wherein the thorium within said envelope is provided in thoriated tungsten wire used for the electrode shanks.

4. An arc tube for a metal halide lamp comprising a vitreous envelope having electrodes sealed into opposite ends and containing an ionizable fill including an inert starting gas, mercury, sodium iodide, and scandium iodide, thorium within said envelope, one of said electrodes comprising a tungsten shank of a size adequate in current-carrying capacity for said lamp projecting into said envelope and an open tungsten wire coil wrapped around the distal end of said shank and spaced from its tip, said coil being made of a composite tungsten wire comprising primary turns of an overwind wire of not more than 4 mils wrapped snugly around a mandrel wire of not more than 5 mils at a winding pitch leaving gaps between turns of at least about the same width as the overwind wire, the composite wire being substantially close-wound on the shank into secondary turns and said coil comprising at least two layers of said secondary turns.

5. An arc tube as in claim 4 wherein the thorium within said envelope is provided as thorium iodide.

6. An arc tube as in claim 4 wherein the thorium within said envelope is provided in thoriated tungsten wire formed into said electrode shanks.

7. An arc tube as in claim 4 wherein the overwind wire is of about 2 mils and the mandrel wire is of about 4 mils.

8. An arc tube as in claim 7 wherein the gaps between primary turns are of about the same width as the overwind wire.

9. An arc tube as in claim 4 wherein the overwind wire is of about 2 mils, the mandrel wire is of about 4 mils, and the coil comprises two layers of secondary turns with the winding pitch reversed between layers.

10. An arc tube as in claim 9 wherein thorium iodide is included in the fill and thoriated tungsten wire is used for the electrode shanks.

* * * * *